US008701643B2

(12) United States Patent
Ellig

(10) Patent No.: US 8,701,643 B2
(45) Date of Patent: Apr. 22, 2014

(54) FALL AWAY ARROW REST SYSTEM

(76) Inventor: Michael J. Ellig, Bozeman, MT (US)

( * ) Notice: Subject to any disclaimer, the term of this patent is extended or adjusted under 35 U.S.C. 154(b) by 221 days.

(21) Appl. No.: 12/960,135

(22) Filed: Dec. 3, 2010

(65) Prior Publication Data

US 2012/0138035 A1 Jun. 7, 2012

(51) Int. Cl.
*F41B 5/22* (2006.01)

(52) U.S. Cl.
USPC ..... 124/44.5

(58) Field of Classification Search
USPC ..... 124/44.5, 41.1
See application file for complete search history.

(56) References Cited

U.S. PATENT DOCUMENTS 6,044,832 A 4/2000 Piersons, Jr.
6,202,635 B1 3/2001 Evans
6,615,813 B1 9/2003 Troncoso, Jr. et al.
6,742,511 B1 * 6/2004 Remme ..... 124/44.5
6,782,881 B2 8/2004 Mizek et al.
6,789,536 B1 9/2004 Summers
7,331,338 B2 2/2008 Mizek
7,409,950 B2 8/2008 Ellig et al.
2006/0157038 A1 * 7/2006 Ellig et al. ..... 124/44.5
2009/0101127 A1 * 4/2009 Johnson ..... 124/25.6

* cited by examiner

*Primary Examiner* — Gene Kim
*Assistant Examiner* — Amir Klayman
(74) *Attorney, Agent, or Firm* — Husch Blackwell LLP

(57) ABSTRACT

The present invention is directed to a fall away arrow rest system for use with a bow. The arrow rest system includes a launcher that is adapted to support a shaft of an arrow prior to the firing of the arrow. Upon the firing of the arrow, the launcher rotates from an upright position to a lowered position in order to move out of the way by the time the tail region of the arrow passes by the launcher. The arrow rest includes a activator body with a locking component to releasably secure the launcher in a lowered position in order to substantially eliminate any bounce back of the launcher and possibility that it may contact the arrow after the arrow is fired.

10 Claims, 8 Drawing Sheets

FALL AWAY ARROW REST SYSTEM

CROSS-REFERENCE TO RELATED APPLICATIONS

None.

BACKGROUND OF THE INVENTION

Arrow rests for compound bows provide a user with a steady surface on which the user can place the shaft of an arrow as the user prepares to aim and fire the arrow at a target. More specifically, arrow rests allow the user to make aiming adjustments based on the surrounding environmental conditions (e.g., wind speed and direction) while reducing the tendency of dropping of the arrow.

One common problem with arrow rests is that the fletching of the arrow, which is necessary for stable arrow flight, may contact the arrow rest when the arrow is fired, thereby changing the desired trajectory and flight path of the arrow. So-called "drop away" arrow rests have been developed to reduce the tendency of the fletching contacting the arrow rest when the arrow is fired. Drop away arrow rests, such as the one described and shown in U.S. Pat. No. 7,409,950, normally include a support element or launcher designed to quickly rotate out of the way just after the arrow is fired. The intent is that the launcher will be completely out of the way by the time the tail region of the arrow, where the fletching is located, passes by the launcher. In order to achieve this rapid rotation, the launcher is normally connected to a biasing means or spring loaded mechanism. However, such arrow rests have inherent deficiencies. Primarily, when the spring loaded launcher reaches the end of its travel, it tends to bounce back up toward its original upright position and contact the arrow shaft and/or fletching as the arrow passes by. This can have an adversely impact by altering the desired trajectory and flight path of the arrow.

Another common problem with arrow rests lies in the design of the support element or launcher in which the arrow is held. Typically, the launcher is made solely of a plastic or metallic material. The arrow shaft, which may be formed from a metallic, plastic, wood, carbon fiber or fiberglass material, creates noise as it moves within the launcher. This noise creates a certain disadvantage to users hunting game, and is especially problematic when the user has sighted game and draws the arrow back to be fired, as the noise can alert the animal of the hunter's presence. Users have adhesively attached materials, such as moleskin, to the launchers in order to reduce the noise. However, these materials undergo wear and can be nuisance to keep adhesively attached to the launchers, especially when hunting in the elements of the outdoors.

Accordingly, a need exists for a fall away arrow rest that prevents the launcher from bouncing back up once the launcher has reached its lowered position. A further need exists for a launcher adapted for use with an arrow rest designed to effectively reduce the noise created by the contact between the arrow shaft and the launcher.

SUMMARY OF THE INVENTION

The present invention involves the provision of a fall away arrow rest that includes a housing having a cavity with an arcuate wall and an indention defined therein, a rotatable shaft extending from the housing, a launcher attached to a distal end of the shaft and an activator disposed within the housing cavity and coupled with the shaft to selectively urge rotation of the shaft and movement of the launcher from an upright position to a lowered position. The activator body includes a locking component that is moveable from a retracted position to an extended position. The locking component may include a plunger and a spring element adapted to urge the plunger from a retracted position to an extended position. The indention is located along the arcuate wall such that the locking component may engage the indention to releasably secure the position of the shaft and launcher when the launcher is in a lowered position. The indention may include a ramp which the plunger engages when the launcher is in a lowered position. The ramp is adapted to engage and push the plunger to a retracted position when the launcher is rotated from the lowered position toward an upright position.

The present invention also involves the provision of a launcher adapted to be coupled with an arrow rest. The launcher is designed to reduce or substantially eliminate the noise developed when an arrow shaft moves or rattles within the launcher. The launcher may include a base and a pair of arms extending from the base forming a channel therebetween. The launcher is constructed of at least two different materials—a first material having a first hardness and second material having a second hardness that is less than the first hardness. The launcher may be formed through an overmolding process. In such a case, at least a portion of the base and arms may be formed of a molded plastic material and may be at least partially overlaid and/or embedded with a rubber material. In one embodiment, the inside surfaces of the arms and the area where the arms meet the base are overlaid with a rubber material in order to reduce the noise developed as an arrow shaft moves or rattles within the channel.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
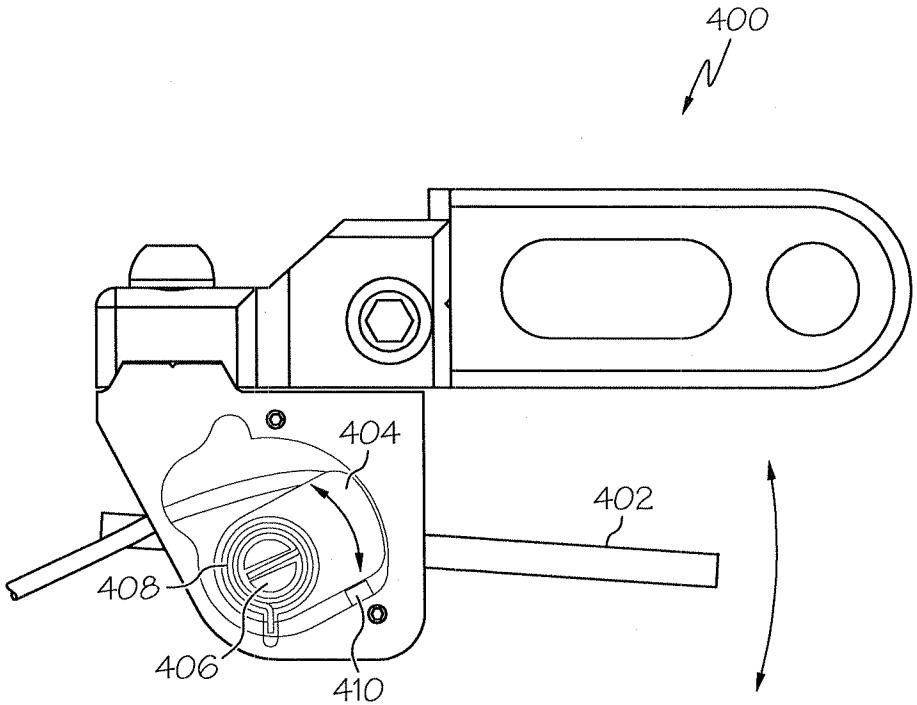
FIG. 1 (PRIOR ART)
FIG. 1 is a right side view of a known arrow rest illustrating its internal components.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The present invention is directed generally to an improved fall away arrow rest system 10. The arrow rest 10 is designed to overcome deficiencies of known arrow rests, including the one indicated by reference 400 in FIG. 1. As illustrated in FIG. 2, the arrow rest 10 is adapted for use with a bow, such as a compound bow 200, having a frame 202 and a bow string 206. While FIG. 2 shows the bow 200 being in a vertical orientation where arrow 300 is aligned in a longitudinal direction on the launcher 18, arrow 300 may obviously be fired from any number of orientations depending upon the desired flight path.

Figure 3A:
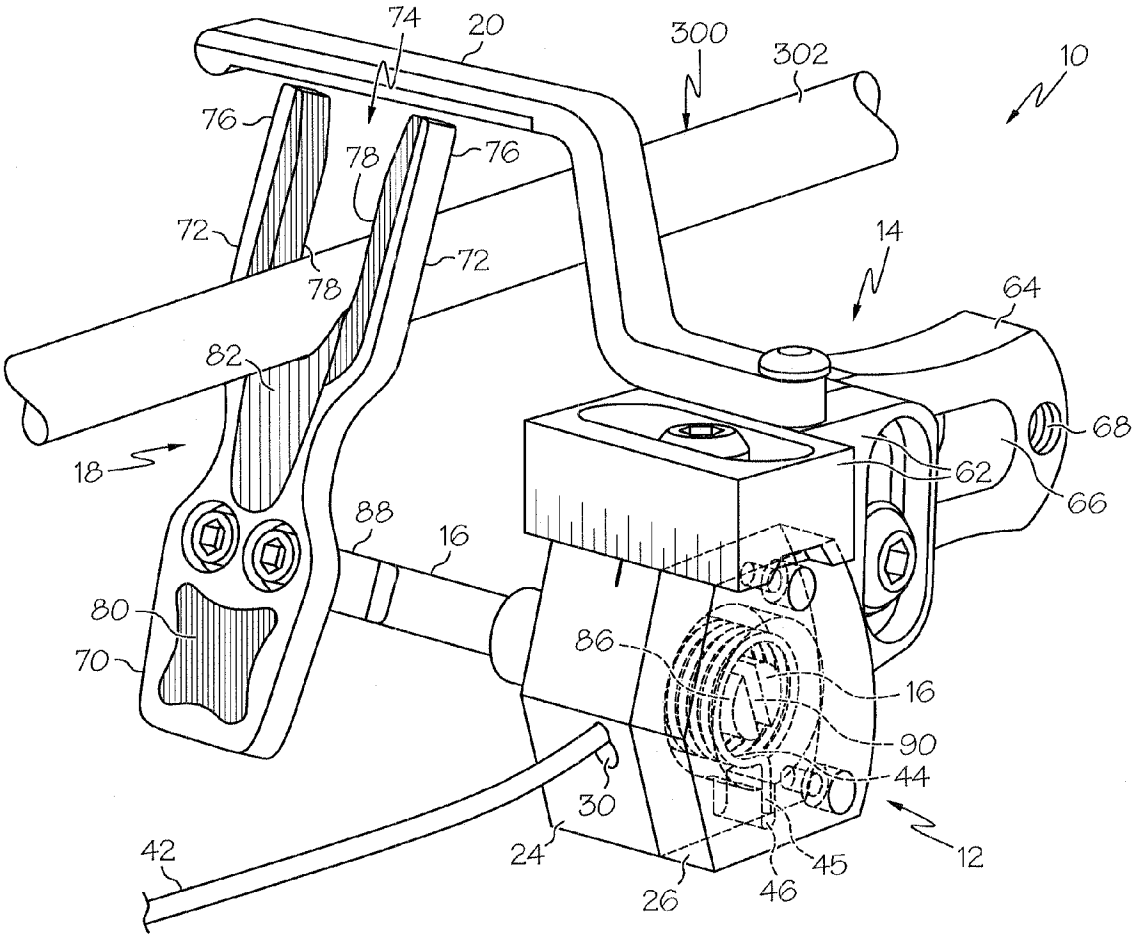
FIG. 3A is a right perspective view of a fall away arrow rest in accordance with one embodiment of the present invention illustrating the launcher in a generally upright position.
Figure 3B:
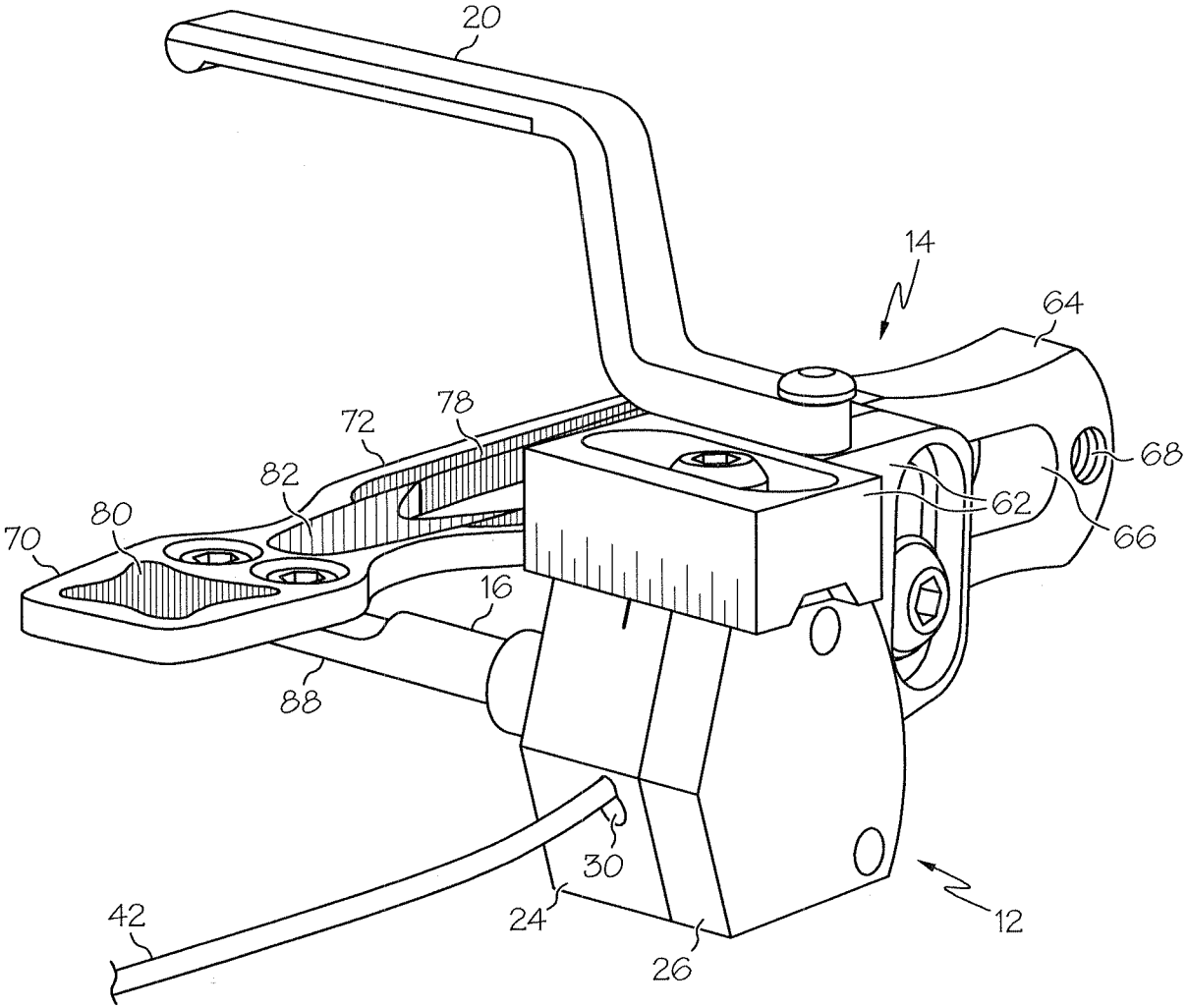
FIG. 3B is a right perspective view of a fall away arrow rest in accordance with one embodiment of the present invention illustrating the launcher in a generally lowered position.
Figure 5A:
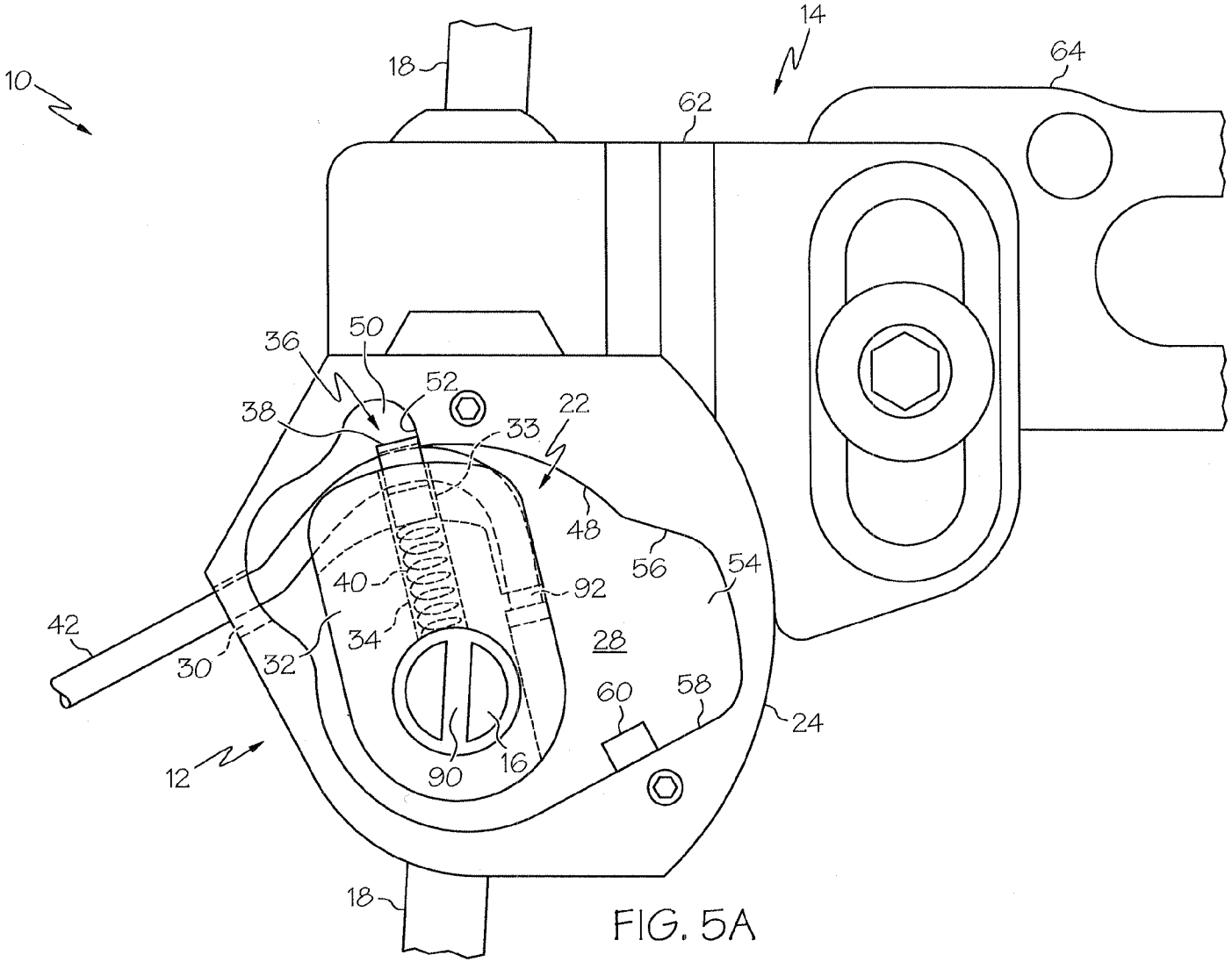
FIG. 5A is a partial diagrammatic right side view of a fall away arrow rest in accordance with one embodiment of the present invention illustrating at least portion of its internal components and showing the launcher in a generally upright and locked position.
Figure 5B:
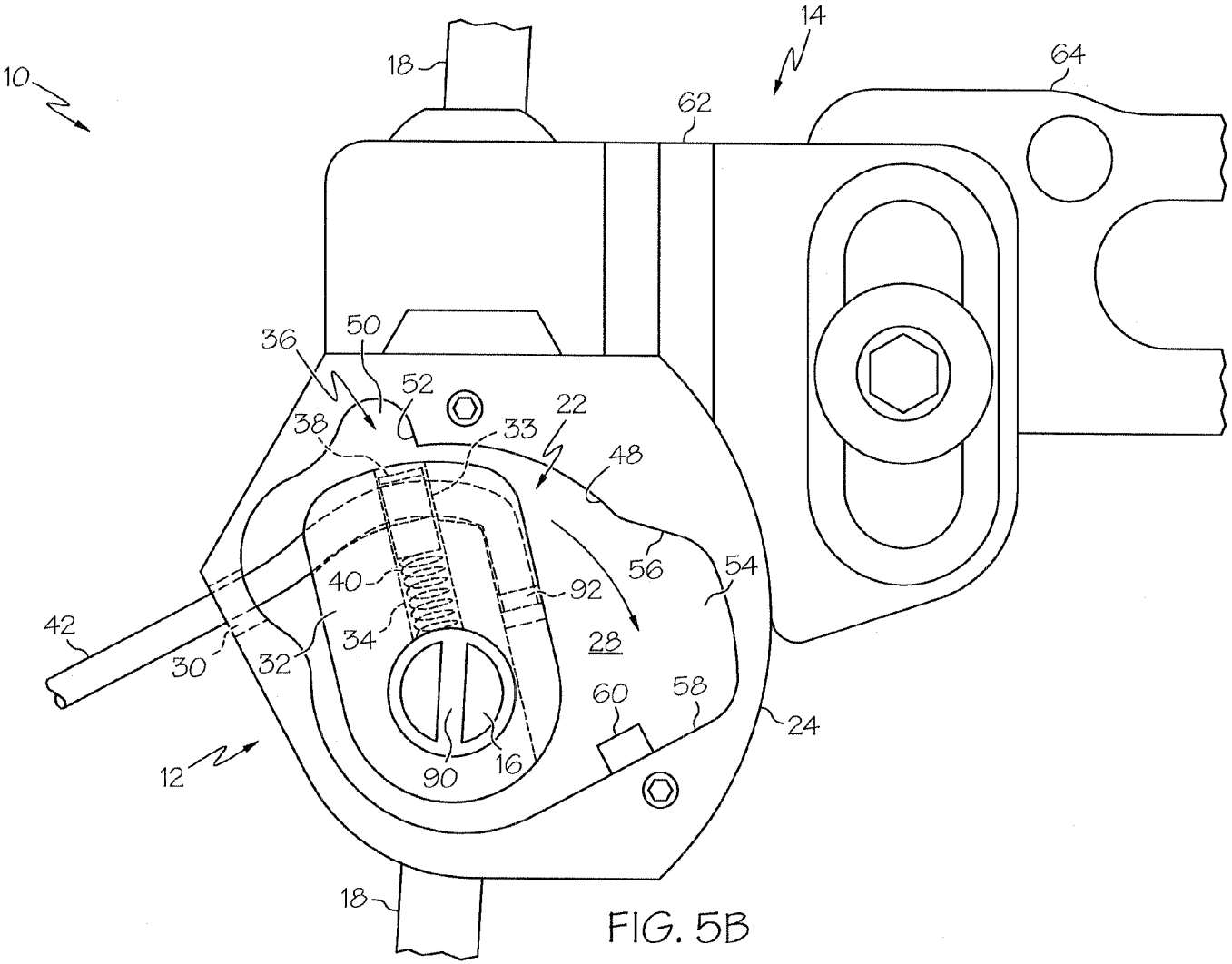
FIG. 5B is a partial diagrammatic right side view of a fall away arrow rest in accordance with one embodiment of the present invention illustrating at least portion of its internal components and showing the launcher in a generally upright and unlocked position.
Figure 5C:
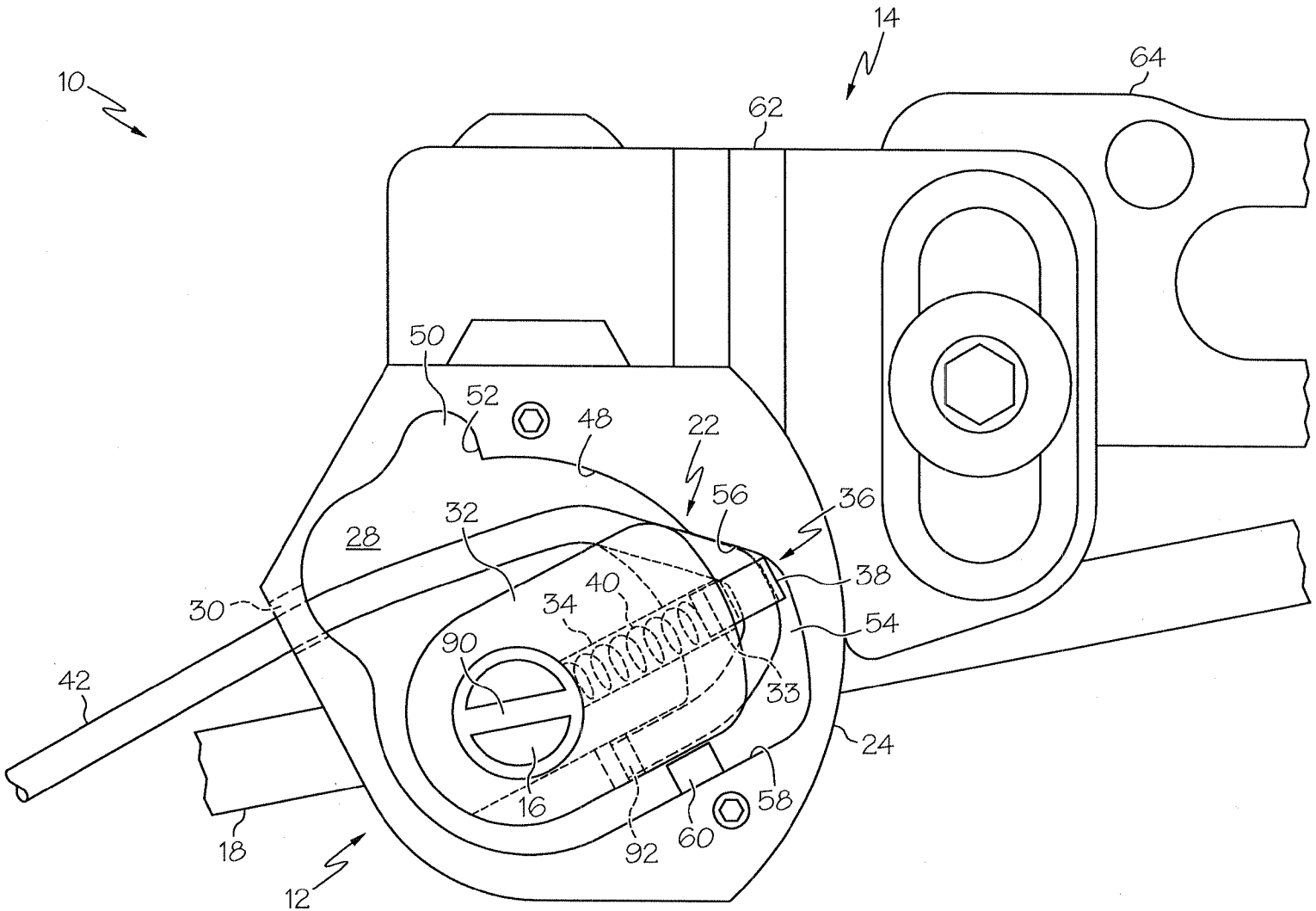
FIG. 5C is a partial diagrammatic right side view of a fall away arrow rest in accordance with one embodiment of the present invention illustrating at least portion of its internal components and showing the launcher in a generally lowered and secured position.

FIGS. 3A and 3B present a more detailed illustration of the overall arrow rest 10, which generally includes a housing 12 for attachment to a compound bow 200 via a mounting structure 14, a shaft 16 rotatably mounted with the housing 12 and extending laterally therefrom, a launcher 18 affixed to the shaft 16 for rotation therewith, an activator 22 (as best seen in FIGS. 5A-5C) disposed within the housing 12 for inducing rotation to the shaft 14 to cause the launcher 18 to move upon the release of the bow string 206, and a cord 42 extending between the activator 22 and a bow cable 208 to control the unlocking of the activator 22. The arrow rest 10 is used by placing the shaft 302 of an arrow 300 on the launcher and engaging a tail section 304 of the arrow 300 with the bow string 206 so that the bow 200 fires or shoots the arrow 300 in a longitudinal direction forwardly of launcher 18. The arrow rest 10, and more particularly the activator 22, is configured to move the launcher 18 from a generally upright position, as shown in FIG. 3A, to a lowered position, as shown in FIG. 3B, such that the launcher 18 is rotated downwardly out of the way of an arrow 300 that has been fired. While the figures depict the arrow rest 10 configured such that the launcher 18 rotates about a generally horizontal axis, it will be appreciated that the launcher 18 may rotate about an axis oriented at any desired angle. For example, the launcher 18 may be oriented transversely and may rotate about a generally vertical axis.

Housing 12, as best seen in FIGS. 3A and 3B, includes a support component 24 and a cover 26. Housing 12 is coupled to the bow 200 through a mounting structure 14 that may include an intermediate component 62 and a bracket 64 having apertures 66 and 68 that may be used to secure the housing 12 to the frame 202 of a bow 200. As shown, the intermediate component 62 and bracket 64 include slotted connections so that the position of the launcher 18 may be adjusted both vertically and horizontally to ensure that the fletching 306 of the arrow 300 does not come into contact with the launcher 18 or any other part of the arrow rest 10 when the arrow is fired. A containment arm 20, as depicted in FIGS. 3A and 3B, may be pivotally secured to an upper surface of the housing 12 or mounting structure 14. As shown, the containment arm 20 is positioned to generally overlie the launcher 18 when the launcher 18 is in an upright position. The function of the containment arm 20 is to prevent the user from accidentally jarring the arrow 300 off of the launcher 18 when moving the bow 200. The containment arm 20 may be rotated to a nonuse position when loading the arrow 300 onto the launcher 16 and then rotated back to the working overlying position once the arrow 300 is on the launcher.

Rotatable shaft 16, to which the launcher 18 is affixed, has a first portion 86 rotatably mounted within housing 12 and extends transversely therefrom in a cantilevered fashion to a second portion 88 where the launcher 18 is mounted.

Figure 4B:
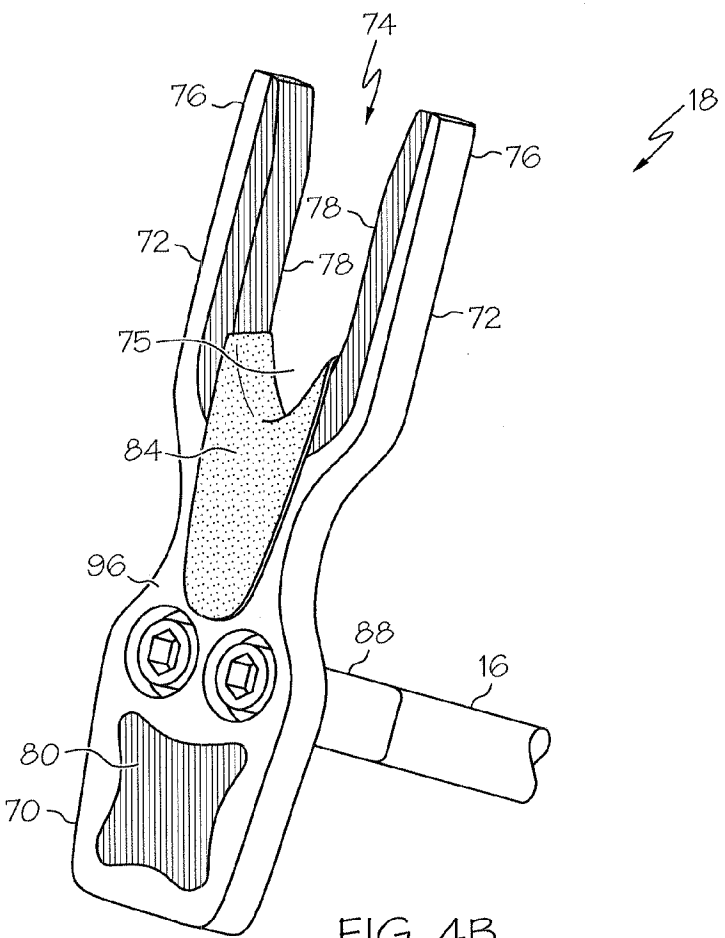
FIG. 4B is a perspective view of another launcher in accordance with one embodiment of the present invention.
Figure 4A:
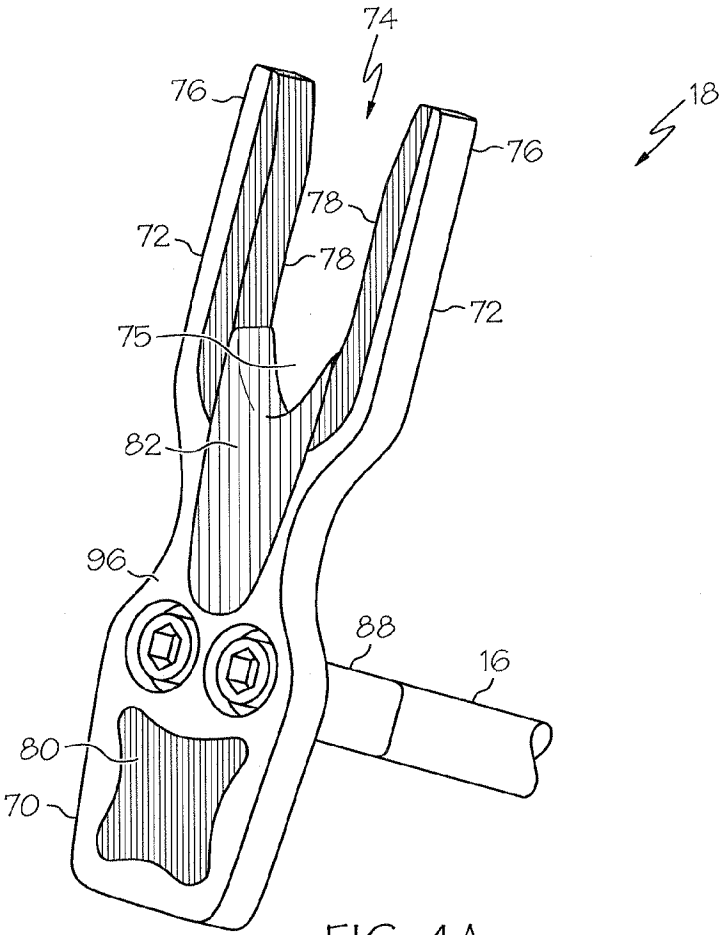
FIG. 4A is a perspective view of a launcher in accordance with one embodiment of the present invention.

Launcher 18, as best seen in FIG. 4A, generally includes a base 70 which is suitable for rigid attachment with the rotatable shaft second portion 88 and a pair of arms 72 extending from the base 70 in a direction away from the shaft 16 to terminal ends 76 thereof forming a channel 74 for accommodating an arrow shaft 302 therein. The arms 72 converge at the base 70 to form a notch 75 where the arrow shaft 302 may rest. As depicted, the launcher 18 may be constructed of two or more materials. In one embodiment, at least a portion of the launcher 18 as represented by the unhatched area 96 (including portions of the arms 72 and base 70) in the figures may be formed of a first generally rigid material having a first hardness. Other portions of the launcher as represented by the hatched areas 78 and 80 may be formed of a second softer material having a second hardness that is less than the first hardness. The first material may include metallic materials, wood, carbon fiber or graphite reinforced polymers, plastics, including but not limited to polypropylene, polyamides, polycarbonates, polybutylene terephthalate, acrylonitrile butadiene styrene, polyethylene terephthalate, polyethylene, polystyrene, thermoplastic polyurethane, any other suitable material now know or hereafter developed and combinations thereof. The first material may have any suitable hardness or durometer. In one embodiment, the first material may have a hardness of about 65 or more Shore D. The second material may include any suitable material such as an elastic polymer material, natural or synthetic rubber, plastics, any other suitable material now know or hereafter developed and combinations thereof. The second material may have any suitable hardness durometer. In one embodiment, the second material may have a hardness of about 70 or less Shore A.

In one embodiment, the first material is a molded plastic material and the second material is an overmolded elastic polymer material, such as rubber. In such an embodiment, the launcher's 18 base 70 and arms 72 may generally be formed as a unitary element of plastic and include areas 78 and 80 of overmolded rubber. The rubber portions 78 and 80 may overlie and/or be embedded in at least potions of the arms 72 and base 70. An area 82 proximate the notch 75 may either be formed of the first material, the second material or different third material having properties differing from the first and second materials. The softer second material, as may be located in areas 78, 80 and 82, is provided in order to reduce or substantially eliminate the noise developed as the arrow shaft 302 moves or rattles within the channel 74 or notch 75. Thus, the launcher 18 may be desirably quiet (due to the softer second material) yet still have adequate stiffness and rigidity (due to the harder first material). In one embodiment, as indicated in FIG. 4B, a portion of the launcher 18 proximate the notch 75 may be covered with a material, such as a moleskin material, as represented by the raised stippled area 84.

The activator 22 and the actions provide by the movement of cord 42 will now be described with continuing reference to the aforementioned figures, and with particular reference to FIGS. 5A-5C. A cavity 28 is formed in the support component 24 of the housing 12 into which the first portion 86 of the shaft 16 extends and within which the activator 22 is housed. The cavity 28 includes a wall 48 (either arcuate as shown or straight) having a notch 50 and an indention 54, as will be described in further detail below, defined therein. Activator 22 includes a body 32 rigidly affixed onto the first portion 86 of the shaft 16, a torsional biasing element 44 (as seen in FIG. 3A) having one end connected to the housing 12 and the other end connected to the shaft 16 to selectively urge rotation of the shaft 16 relative to the housing 12, and a locking component 36 to regulate rotation of shaft 16.

The torsional biasing element 44 may be a torsion spring having one end (not shown) placed within a groove 90 defined in the first end 86 of the shaft 16 and a second end 45 placed within a groove 46 defined in the housing 12, as illustrated in FIG. 3A. The locking component 36 may include a retractable stop or plunger 38 movable linearly within a slot 33 defined within the body 32 and a stop biasing element 40, such as a compression spring disposed within a bore 34 defined within the body 32, for urging a portion of the plunger 38 out of the body 32. The plunger 38 may selectively occupy an extended or retracted position. The portion of the plunger 38 that extends out of the body 32 when the plunger 38 is in an extended position provides the locking feature for the activator 22 by abutting a contact surface 52 of the notch 50 formed in the housing cavity 28, as seen in FIG. 5A. Through the rotational urging of the shaft 16 (and therefore the body 32 of the activator 22 affixed thereto) provided by torsional biasing element 44, plunger 38 is engaged with the notch 50 and only becomes disengaged through retraction of the plunger 38 out of the notch 50.

Retraction of the plunger 38 is caused by a force applied to the plunger 38 in a direction radially inward toward the shaft 16. Such force must be sufficient to overcome the frictional engagement between the plunger 38 and the contact surface 52 and the force exerted by the biasing element 40 in the body 32. This retraction force may be provided by pulling a cord 42 extending through the plunger 38 and having one end affixed to the body 32 and another free end 94 extending out of the housing 12 through a passageway 30, which may be attached to a bow cable 208 with a clip 210.

The disengaging of locking component 36 (shown in FIG. 5B) enables, upon releasing the tension or pulling force applied to the cord 42, torsional biasing element 44 to cause rotation of the shaft 16 and body 32 affixed thereto. The body 32 rotates through cavity 28 from a first position shown in FIGS. 5A and 5B towards a second position shown in FIG. 5C under the influence of the torsional biasing element 44. As demonstrated in FIGS. 5A and 5B, when the activator body 32 is in the first position, the shaft 16 positions the launcher 18 at a generally upright arrow support position and, as demonstrated in FIG. 5C, when the activator body 32 is in the second position, the shaft 16 positions the launcher 18 at a lowered position. Cavity 28 has an arcuate wall 48 with a sliding surface which the plunger 38 freely slides against once the plunger 38 clears the notch 50 and the body 32 begins rotation towards the second position. Rotation of the body 32 and shaft 16 continue until the body 32 reaches a rotation limiting wall 58 of the cavity 28. A rubber damper or stop 60 or similar object may be placed on the rotation limiting wall 58.

Figure 2:
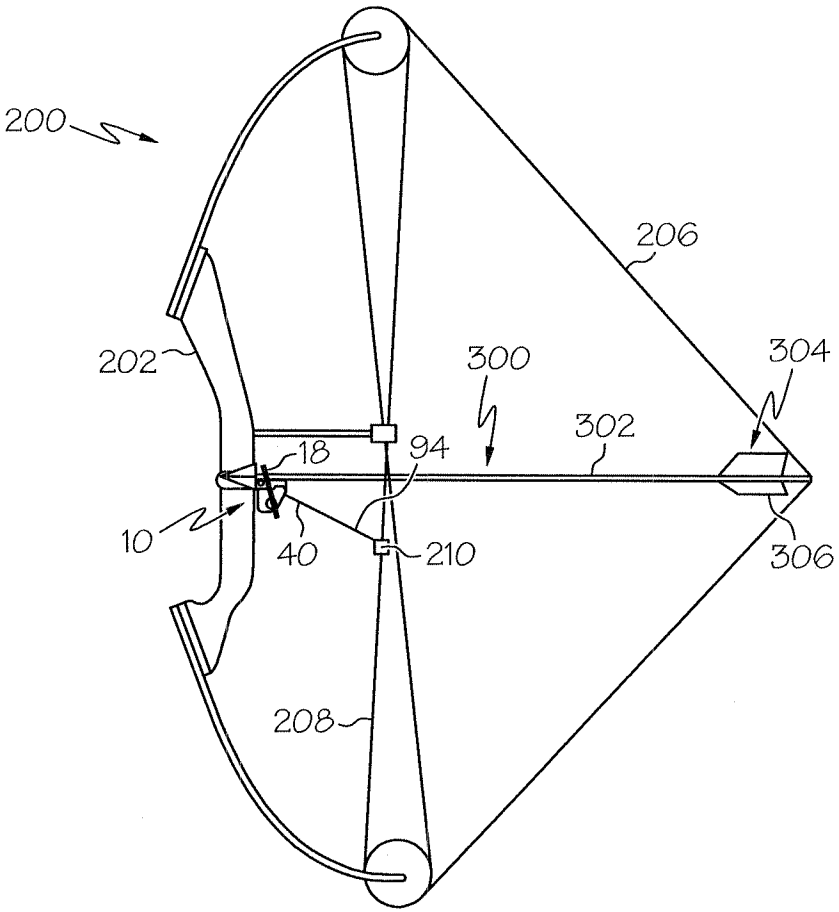
FIG. 2 is a left side view of a fall away arrow rest in accordance with one embodiment of the present invention in use with a compound bow.

One of the problems with known arrow rests, like the one shown in FIG. 1, is that when the torsional spring 408 snaps the activator body 404 from a first position to a second position in order to rotate the shaft 406 and place the launcher 402 in a lowered position, the activator body 404 tends to bounce back towards the first position once it contacts the rotation limiting wall or the rubber damper 410 paced thereon. When this occurs, the launcher 402 bounces back up towards its upright position and may contact the arrow shaft and/or fletching as the arrow passes by. This has an adverse impact by altering the desired trajectory and flight path of the arrow thereby hindering the user's ability to hit the target.

As illustrated in FIGS. 5A-5C, the arrow rest 10 includes a housing 12 with a cavity 28 defined therein having an indention 54 with a ramp 56 formed into an arcuate wall 48 of the cavity 28. Such a design entirely prevents or at least substantially eliminates the undesirable bounce back of the activator body 32 and launcher 18 once the activator body 32 and launcher 18 have reached their lowered positions. As demonstrated in FIG. 5C, once the activator body 32 nears its lowered position, the indention 54 allows the plunger 38 to return to an extended position. As such, the plunger 38 engages the ramp 56 as the activator body 32 approaches its lowered position. Once the body 32 reaches its lowered position, the plunger 38 continues engagement with the ramp 56 to prevent the body 32 (and thus the launcher 18) from bouncing back towards its upright position. In one embodiment, the linear force created by the locking component 36 against the angled ramp 56 urges the activator body towards its second (lowered) position. This in turn counteracts any bounce back that the activator body 32 would otherwise undergo and keeps the activator body 32 (and thus the launcher 18) in its lowered position. Once the activator body 32 and launcher 18 are in their lowered positions, as depicted in FIG. 5C, the body 32 and launcher 18 are in generally releasably secured positions. The rotation of the body 32 and launcher 18 is restricted in both a clockwise direction and a counterclockwise direction.

The indentation 54 may of any suitable size and depth and the ramp 56 may be disposed at any suitable angle in order to prevent bounce back. As will be appreciated, an indentation 54 need not extend clear to the rotation limiting wall 58 and only needs to be sized to accommodate the width of the plunger 38. In another embodiment, the indentation 54 does not include a ramp 56 but rather has a steeper surface similar to the contact surface 52 of the notch 50.

In one method of use, a user first grasps the launcher 18 and rotates it upwardly from the lowered position (shown in FIGS. 3B and 5C) to the upright arrow support position (shown in FIGS. 2, 3A, 5A and 5B). If the containment arm 20 has been rotated away from the working position so that it does not overlap the launcher 18, then an arrow 300 can be loaded onto the launcher 18 in the upright arrow support position to prepare for arrow firing. Then, the containment arm 20 may be swung to the working position to overlap the arrow 300 positioned on the launcher 18. On the other hand, if the containment arm 20 is already in the working position, then the arrow 300 may be loaded onto the launcher 18 in the lowered position prior to rotating the launcher 18 to the upright arrow support position. In either case, once the arrow 300 is loaded on the launcher 18, the containment arm 20 is in the working position, and the launcher 18 is in the upright arrow support position, a vertical gap formed between the terminal ends 76 of the launcher arms 72 and the containment arm 20 is preferably less than the diameter of a standard arrow 300, so that the arrow 300 may not slip over the launcher arms 72 and fall off of the launcher 18.

Corresponding to the launcher 18 being in the upright arrow support position, the activator 22 is in the first position shown in FIG. 5A where the body 32 has been rotated away from the rotation limiting wall 58 and the plunger 38 has engaged with the housing cavity notch 50. In rotating the body 32 from the second position to the first position, the ramp 56 pushes and guides the plunger 38 to a retracted position within the body 32. The user will then engage the tail section 304 of the arrow 300 with the bow string 206 to prepare for arrow firing. As the user draws the bow string 206, the plunger 38 is retracted into the body 32 as shown in FIG. 5B. Drawing of the bow string 206 must be of a sufficient magnitude for the plunger 38 to retract far enough to the clear the notch 50, and the magnitude may be selected by the user according to the location where the cord 42 is clipped to the bow string 206 or bow cable 208. Releasing of the drawn bow string 206 releases the tension on the cord 42, allowing the torsional biasing element 44 to move the body 32 toward the rotation limiting wall 58 to the second position shown in FIG. 5C. As a result of this motion, the shaft 16 and launcher 18 are rotated to the lowered position. Because releasing of the bow string 206 will immediately propel the arrow 300 forwardly, the fact that the launcher 18 begins to rotate downwardly does not significantly affect the flight path or trajectory of the fired arrow 300. The launcher 18 provides the support and positioning of the arrow 300 right up to the time of release of the bow string 206. The launcher 18 rotates downwardly upon firing at a sufficiently fast rate as to allow the arrow fletching 306 to clear the launcher 18 as the arrow 300 is moving forwardly and traveling to the intended target. The containment arm 20 is configured so that the arrow fletching 306 will not contact the arm 320 when traveling therebeneath upon arrow firing.

In another method of use, the arrow 300 is first loaded onto the launcher 18 in the lowered position. The tail section 304 of the arrow 300 is also engaged with the bow string 206 to prepare for firing. Drawing the bow string 206 causes the cord 42 to pull on the plunger 38 with a force vector having a component directed radially inwardly towards the shaft 16 and a component directly rearward, thereby rotating body 32 from the activator second position shown in FIG. 5C towards the position shown in FIG. 5B where plunger 38 is aligned with the notch 50 but remains retracted in the housing 32 due to the tension on the cord 42. Thus, the bow string 206 drawing moves the launcher 18 from the lowered position to the upright arrow support position. The raised lateral portions of the arms 72 aid in maintaining the arrow 300 on launcher 18 as the launcher 18 is rotating upward to the upright arrow support position. The softer second material located at 80 on the base 70 aids in preventing the arrow shaft 302 from contacting the first harder material and thereby eliminates or at least significantly reduces any noise associated with loading the arrow 300 in this manner. Releasing of the bow string 206 to fire the arrow 300 causes corresponding release of the tension on the cord 42, enabling the torsional biasing element 44 to move the body 32 towards the second position shown in FIG. 5C, thereby rotating the shaft 16 and launcher 18 to the lowered position. With this method, the plunger 38 doesn't engage with the notch 50 (unless the user holds the launcher 18 once in the upright arrow support position and lets down the bow string 206), but the activator body 32 may rotate through a desired range of rotation within the housing cavity 28 depending on the magnitude of motion of the bow string 206 or the bow cord 208 to which the cord 42 is attached. In other words, the activator body 32 may rotate fully from the second position shown in FIG. 5C to the position shown in FIG. 5B (corresponding with the first position but with plunger 38 retracted into body 32), and then back to the second position. As set forth above, the indentation 54 and ramp 56 prevent any significant bounce back of the body 32 and launcher 18 once they reach the second position.

It should be understood that the arrow rest 10 can be oriented in a number of other ways, including in the mirror image of what is shown in the figures in order to accommodate left-handed users. It should also be understood that while arrow rest 10 is shown in the figures as having a shaft 16 having a generally horizontal axis in order to rotate the launcher 18 between upright and lowered positions, the arrow rest 10 may by configured and mounted to the bow 200 in a fashion such that the launcher 18 may rotate on a different axis, such as a vertical axis, in order to move the launcher 18 out of the way of the arrow 300.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A fall away arrow rest system for use with a bow, the arrow rest comprising:

a housing adapted for coupling with the bow, the housing, including a cavity having an arcuate wall with an indention defined therein;

a rotatable shaft including a first portion mounted with and supported by the housing and a second portion extending from the housing;

a launcher attached to the second portion of the shaft; and an activator body disposed within the housing cavity and coupled with the shaft, the activator body being operative to selectively urge rotation of the shaft and movement of the launcher from an upright position to a lowered position, and including a locking component moveable from a retracted position to an extended position wherein said locking component extends into said extended position and is received into said indention in said arcuate wall of the housing to substantially eliminate the launcher from bouncing back up when the launcher moves from the upright position to the lowered position.

2. The arrow rest of claim 1, wherein the indentation includes a ramp and the locking component engages the ramp when the launcher is in the lowered position.

3. The arrow rest of claim 2, wherein the ramp is adapted to engage and push the locking component from an extended position to a retracted position when the launcher is rotated away from its lowered position by a user.

4. The arrow rest of claim 1 wherein said wall is arcuate in profile and wherein the rest further comprises a stop that limits the rotation of the activator body once the launcher has reached the lowered position.

5. The arrow rest of claim 4 further comprising a torsional biasing element for urging rotation of the activator body toward the stop and rotation of the launcher toward the lowered position.

6. The arrow rest of claim 4, wherein the rotation of the launcher is restricted in both a clockwise direction and a counterclockwise direction when the launcher is in the lowered position.

7. The arrow rest of claim 1, wherein the locking component includes a plunger and a spring element adapted to urge the plunger from a retracted position to an extended position.

8. The arrow rest of claim 1, wherein the launcher, is at least partially formed of a first material having a first hardness and a second material having a second hardness overlying at least a portion of the first material.

9. The arrow rest of claim 1, wherein said wall is arcuately shaped in profile.

10. The arrow rest of claim 8, wherein the first material is a molded plastic material and the second material is an overmolded rubber material.

* * * * *